US005577478A

United States Patent [19]

Tuckey

[11] Patent Number: 5,577,478

[45] Date of Patent: Nov. 26, 1996

[54] INTEGRATED FUEL PRESSURE REGULATOR AND RAIL ASSEMBLY

[75] Inventor: Charles H. Tuckey, Cass City, Mich.

[73] Assignee: Walbro Corporation, Cass City, Mich.

[21] Appl. No.: 552,800

[22] Filed: Nov. 3, 1995

[51] Int. Cl.[6] ..... F02M 55/02

[52] U.S. Cl. ..... 123/456; 123/457

[58] Field of Search ..... 123/456, 497, 123/514, 468–9, 457, 459, 462

[56] References Cited

U.S. PATENT DOCUMENTS

| | | | |
|---|---|---|---|
| 4,798,187 | 1/1989 | Hudson, Jr. | 123/469 |
| 4,805,575 | 2/1989 | De Concini et al. | 123/456 |
| 4,984,548 | 1/1991 | Hudson, Jr. | 123/470 |
| 5,080,069 | 1/1992 | Hudson, Jr. | 123/456 |
| 5,090,385 | 2/1992 | Usui et al. | 123/456 |
| 5,146,896 | 9/1992 | Imehl et al. | 123/456 |
| 5,355,859 | 10/1994 | Weber | 123/456 |
| 5,398,655 | 3/1995 | Tuckey | 123/456 |

*Primary Examiner*—Thomas N. Moulis
*Attorney, Agent, or Firm*—Barnes, Kisselle, Raisch, Choate, Whittemore & Hulbert

[57] ABSTRACT

For a fuel injected engine with a no-return fuel system, a fuel rail assembly with an integrated fuel pressure regulator. The fuel rail assembly has a plurality of spaced apart fuel injector sockets each communicating through a fuel passage with a demand pressure regulator removably mounted on the fuel rail upstream of all the fuel injector sockets to regulate the pressure of all fuel supplied to fuel injectors received in the sockets.

20 Claims, 2 Drawing Sheets

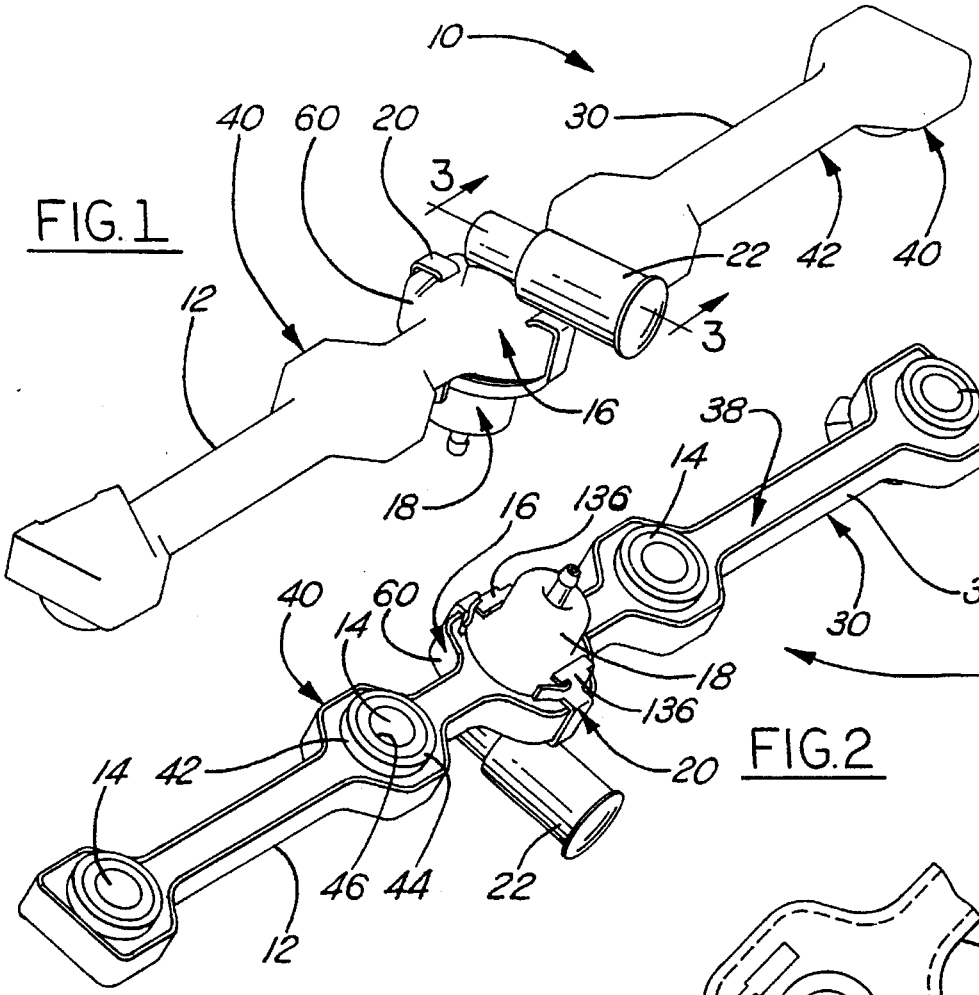
FIG. 1
FIG. 2
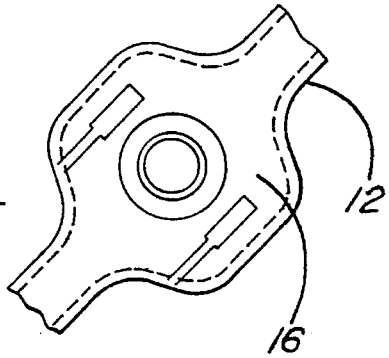
FIG. 6
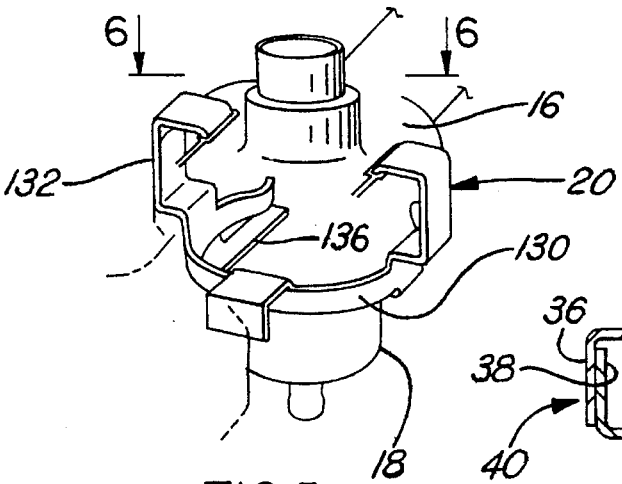
FIG. 5
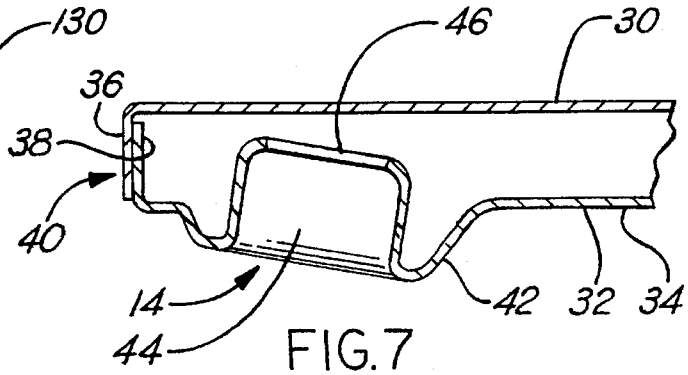
FIG. 7

INTEGRATED FUEL PRESSURE REGULATOR AND RAIL ASSEMBLY

FIELD OF THE INVENTION

This invention relates to fuel rails, and more particularly to a fuel rail assembly with an integrated fuel pressure regulator.

BACKGROUND OF THE INVENTION

One of the objectives of the automotive industry is to simplify component assembly and installation procedures to reduce the time and cost of vehicle assembly. One approach to achieve this goal is to combine components of various vehicle systems into modular assemblies prior to delivering the components to the vehicle assembly line.

Today, many automotive internal combustion engines have a fuel injection system. Fuel pressure regulators are included with these types of fuel systems to control fuel pressure within the fuel rails. It is known in the art to include a fuel pressure regulator downstream of the fuel rail and fuel injectors to provide pressure relief bleeding off excess fuel from the rail back to the fuel tank or reservoir. It is also known in the art to mount this type of fuel pressure regulator on the downstream end of the fuel rail beyond all the fuel injectors. Additionally,.it is also known to provide a demand type fuel pressure regulator upstream of the fuel rail and injectors somewhere in the fuel delivery line.

The demand fuel pressure regulator is used in returnless systems and has a reference line typically connected to either the air intake manifold or to atmosphere. When referenced to the intake manifold, the fuel pressure regulator maintains a constant pressure drop across the injectors. This type of referencing is particularly useful on engines having a turbo charger or supercharger.

The demand type regulator also may be combined with an over pressure relief valve positioned upstream of the regulator between the fuel pump outlet and the regulator inlet for bleeding excess fuel back to the tank. The relief valve opens when the fuel pressure in the rail increases and bleeds back through the regulator during what is known as a hot soak condition or fuel expansion caused by excessive heat accumulated in the fuel rail.

SUMMARY OF THE INVENTION

A fuel rail assembly is provided for a no-return fuel delivery system for an internal combustion engine which carries thereon a demand fuel pressure regulator for providing fuel at a regulated pressure to a plurality of fuel injectors. Generally, the fuel rail assembly has an elongate fuel rail preferably with a generally circular cross section which defines a rail fuel passage therein. The fuel rail also has a plurality of fuel injector sockets each for receiving and retaining a fuel injector therein. The injector sockets each have a socket aperture which communicates with the rail fuel passage and the fuel inlet of each injector.

The fuel pressure regulator has a fuel inlet which communicates with a fuel reservoir in a fuel tank and a fuel outlet for delivering fuel to the fuel rail. The pressure regulator is received and retained in a regulator socket formed integrally with the fuel rail so that the fuel outlet of the regulator is disposed upstream of the injector sockets. Fuel flows from the fuel pump through a delivery line to the pressure regulator inlet and then flows from the regulator outlet through an aperture in the regulator socket and into the rail fuel passage and thence to the fuel injectors.

Objects, features and advantages of this invention include providing a fuel rail assembly with a demand fuel pressure regulator thereon disposed upstream of the fuel injectors, which reduces the amount of space necessary for installing the components, reduces the cost of shipping and assembling the components, reduces noise created by the operation of the fuel injectors to provide a quieter operation, decreases the response time and increases the efficiency of the fuel system, and is simple, rugged, durable, reliable, and of relatively simple design and economical manufacture and assembly.

BRIEF DESCRIPTION OF THE DRAWINGS

These and other objects, features and advantages of this invention will be apparent from the following detailed description of the preferred embodiment and best mode, appended claims, and accompanying drawings in which:

FIG. 1 is a perspective top view of a fuel rail assembly embodying the invention;

FIG. 2 is a perspective bottom view of the fuel rail assembly of FIG. 1 rotated 180° end to end;

FIG. 5 is a phantom view of the demand fuel pressure regulator portion of the fuel rail assembly of FIG. 1 illustrating a fuel pressure regulator retaining clip;

FIG. 6 is a top view of the demand fuel pressure regulator portion of the fuel rail assembly of FIG. 1 with the retaining clip and the regulator fuel inlet removed; and FIG. 7 is a sectional view of a fuel injector socket taken along line 7—7 of FIG. 1.

DETAILED DESCRIPTION

Figure 3:
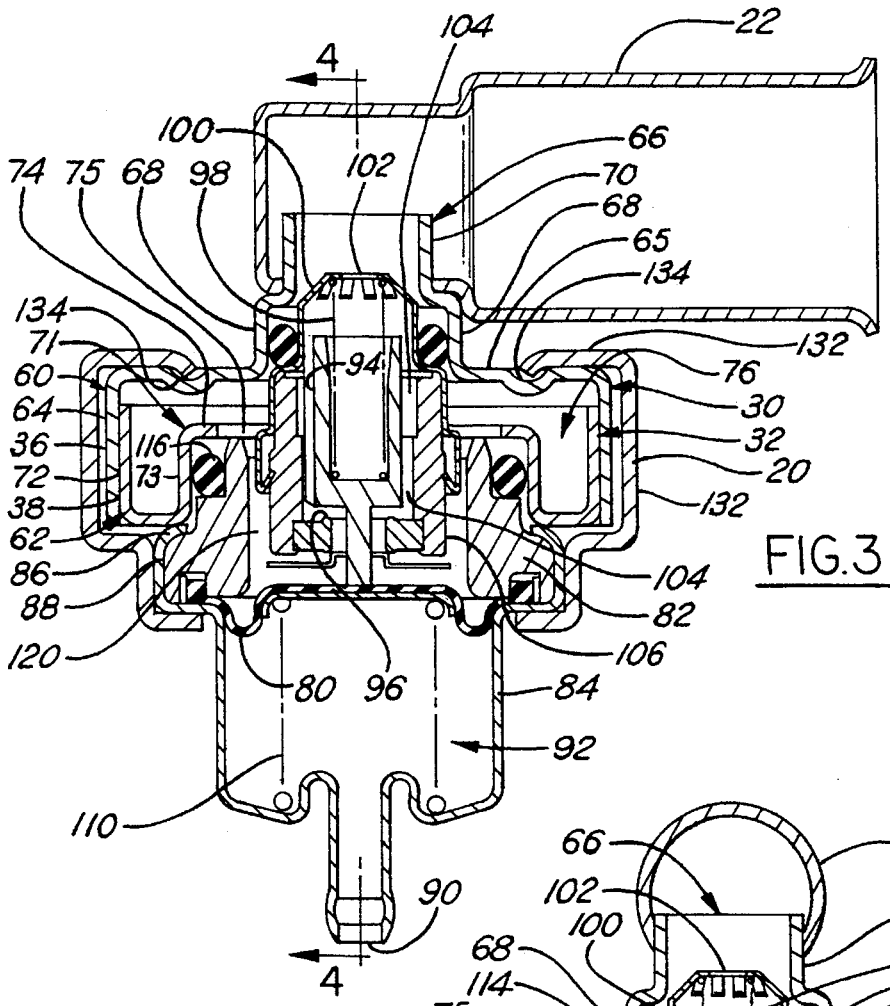
FIG. 3 is a sectional view of the demand fuel pressure regulator taken along line 3—3 of FIG. 1.

With reference to the drawings, FIGS. 1 and 2 illustrate a fuel rail assembly 10 embodying this invention for an internal combustion engine of an automobile. The rail assembly 10 has an elongate fuel rail 12 with a plurality of fuel injector sockets 14 spaced along the rail for receiving the fuel inlet end of a fuel injector (not shown). The rail 12 also has a fuel pressure regulator socket 16 for receiving and retaining therein a demand fuel pressure regulator 18. The regulator 18 is held in place in the regulator socket 16 by a spring clip 20 and has a fuel line connector 22 attached thereto for communicating with a fuel pump through a fuel delivery line (not shown) attached to the connector.

The fuel rail 12 is preferably of a two piece construction with an upper rail section 30 and a confronting lower rail section 32, each having a generally U-shaped cross section. When assembled together in confronting relationship, the upper section 30 and lower section 32 define a generally cylindrical rail fuel passage 34 therebetween. Each of the rail sections 30 and 32 may be formed from sheet metal such as steel by a typical stamping process.

Preferably, the lower rail section 32 fits within the upper rail section 30 such that the upper rail sides 36 overlap the lower rail sides 38. After assembly, the upper section 30 and lower section 32 are sealingly bonded together, such as by furnace brazing, to form the elongate fuel rail 12. The fuel rail 12 has a plurality of nodular or dome sections 40 spaced apart along the rail and connected in series by intermediate arterial sections 42 having a smaller cross sectional size.

Each of the injector sockets 14 is disposed in one of the nodular sections 40 which as shown in FIG. 7 has an annular prominence 43 with a well 44 therein. The well 44 is formed in the lower section 32 and has an aperture 46 communicating with the rail fuel passage 34. The inlet end of a fuel injector (not shown) is received in the well 44 with an inlet communicating with the aperture 46 for receiving fuel from within the passage 34 through the dome 46. The construction of the injector sockets 14 is described herein for illustration purposes only and may take on any number of configurations without departing from the invention.

Figure 4:
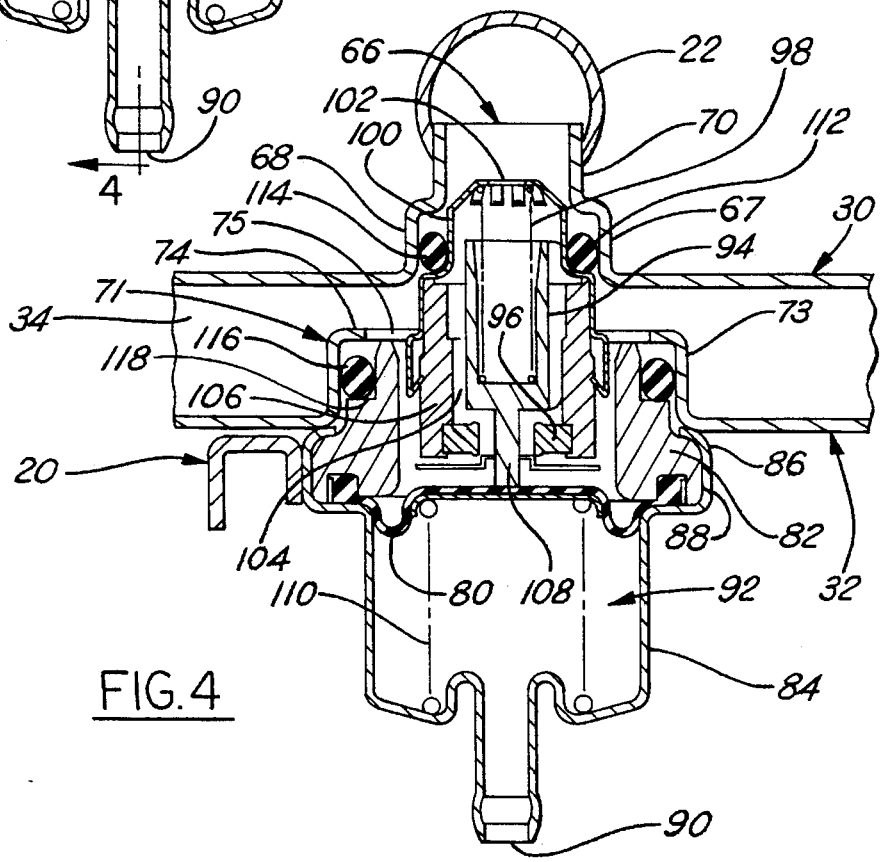
FIG. 4 is a sectional view of the pressure regulator taken along line 4—4 of FIG. 3.

As shown in FIGS. 3 and 4, the pressure regulator socket 16 is defined by an upper flared section 60 formed in the upper rail 30 and a confronting lower annular flared section 62 formed in the lower rail 32. The upper flared section 60 has a depending outer wall portion 64 and an end wall 65 which in combination define a cup-shaped well therein. A fuel inlet 66 is centrally disposed in the end wall 65 and is defined by an upwardly projecting cylindrical nipple 68 which has a reduced diameter end 70 connected with the fuel line connector 22.

The lower flared section 62 has a socket 71 formed for receiving the pressure regulator 18 therein. The annular flared section 62 has a generally U-shaped cross section defined by an upturned outer wall 72 and an upturned inner annular wall 73 with an inturned flange 74 and an aperture 75 spaced from the regulator 18. An annular fuel passage 76 is defined by the walls 64, 65, 72 and 73 which communicates with the rail fuel passage 34 through the adjacent arterial sections 42. The aperture 75 permits fuel to enter the annular passage 76 from the regulator 18.

As shown in FIGS. 3 and 4, the regulator 18 has a flexible diaphragm 80 clamped between an upper housing 82 and a lower housing 84 which has an annular skirt 86 spun over a flange 88 of the upper housing 82. The lower housing 84 has an air inlet 90 which communicates with either the intake manifold of the engine or atmospheric air and leads into a chamber 92 defined by the lower housing 84 and the diaphragm 80. Disposed within the upper housing 82 is a valve body 94 which is biased against a valve seat 96 by a compression spring 98 and retained in the housing by an annular clip 100. A fuel inlet 102 through the clip communicates with the valve seat through fuel passages 104 in the housing adjacent the valve.

The valve body 94 has a pin 108 which bears on the diaphragm 80 for movement thereby and preferably a second closure member and flow deflector 106 secured thereto. The closure member 106 prevents reverse flow of fuel from the rail. The diaphragm 80 and hence the valve body 94 is biased by a second compression spring 110 to the position shown in FIG. 4 when no fuel is supplied to the rail. The forces acting on the valve body 94 are the force of the compression spring 98, the pressure of fuel received in the inlet 102, the force of the second compression spring 110 against the diaphragm, the resistance or back pressure of fuel in the rail acting on the diaphragm, and the air pressure within the chamber 92 which is either the air intake manifold pressure or atmospheric pressure.

The pressure regulator 18 is installed in the fuel rail 12 by inserting the inlet 100 through the opening 71 of the lower flared section 62. A first O-ring 112 is fitted over and abuts a shoulder 114 of the inlet 100 and provides a seal between the inlet 100 and the nipple 68 forcing fuel to enter the rail 12 only through the regulator 18 via the inlet opening 102.

A second 0-ring 116 is fitted over and abuts a shoulder 118 on the regulator upper housing 82 and provides a seal between the upper housing and the upturned inner wall 73 of the lower flared section 32. A plurality of regulator fuel outlet passages 120 in the upper housing 82 open through the aperture 75 to supply fuel to the passage 34 of the rail between the O-rings 112 and 116.

To retain the regulator 18 in the socket 16, the spring clip 20 has a horseshoe shaped resilient band 130 constructed and arranged to snap around the pressure regulator skirt 86 and flange 88. The clip 20 has a pair of upper claws 132 which are received in a pair of corresponding depressions 134 in the upper flared section 60 as the clip 20 is snapped around the pressure regulator 18. The clip 20 also has a pair of lower fingers 136 constructed and arranged to snap over the skirt 86 of the fuel pressure regulator 18 forcing the regulator into the socket 16 and retaining it therein.

The fuel inlet connector 22 communicates with a fuel pump to provide liquid fuel under pressure through the inlet opening 66 and into the fuel inlet 100. The regulator 18 is designed to deliver fuel at a substantially constant system pressure such as 50 psi, thus the fuel delivered from the pump is delivered at a slightly higher pressure such as 55 psi. The valve body 94 rapidly moves in response to the various forces of the springs, the fuel pressure and the air pressure by rapidly opening and closing against the valve seat 96 and under dynamic engine operating conditions rapidly hunts or oscillates to maintain a substantially constant fuel delivery pressure to the fuel injectors.

I claim:

1. A fuel rail assembly for a no-return fuel delivery system for an internal combustion engine with a plurality of fuel injectors each having an injector fuel inlet, the rail assembly comprising:

a fuel rail constructed of an elongate member having a cross section defining a rail fuel passage therein and having a plurality of fuel injector sockets each for receiving one fuel injector inlet therein and each having a socket aperture communicating with said rail fuel passage and said injector fuel inlet, a demand fuel pressure regulator for providing fuel at a regulated pressure through said rail fuel passage to all of said fuel injectors through said socket apertures, said regulator having a fuel inlet communicating with a fuel reservoir, and at least one fuel outlet communicating with said fuel rail passage, and a pressure regulator socket formed integrally with said fuel rail for receiving said regulator therein such that said regulator fuel outlet is disposed upstream of all of said injector sockets for providing fuel at a regulated pressure directly to said injectors through said rail fuel passage and wherein said rail has no return fuel outlet downstream of any of the fuel injectors, and said regulator socket is disposed longitudinally between the fuel injector sockets to substantially minimize and equalize the linear distance fuel must travel from said regulator to the most remote of said injectors on both sides of said regulator socket.

2. The fuel rail assembly of claim 1 wherein said regulator socket comprises an annular ring formed integrally with said fuel rail, said ring having a generally circular cross section defining a regulated fuel passage therein which opens into said rail fuel passage for delivering fuel from said regulator outlet to said injectors through said rail fuel passage.

3. The fuel rail assembly of claim 2 wherein the pressure regulator is retained in said regulator socket by a spring clip.

4. The fuel rail assembly of claim 2 wherein said regulator socket is disposed at about the longitudinal mid-point of said rail assembly.

5. The fuel rail assembly of claim 1 wherein the fuel rail comprises an elongated top section and a similarly elongated confronting bottom section, and said sections are sealingly joined together and define said fuel rail passage.

6. A fuel rail assembly for a no-return fuel delivery system for an internal combustion engine with a plurality of fuel injectors each having an injector fuel inlet, the rail assembly comprising:

a fuel rail constructed of an elongate member having a cross section defining a rail fuel passage therein and having a plurality of fuel injector sockets each for receiving one fuel injector inlet therein and each having a socket aperture communicating with said rail fuel passage and said injector fuel inlet, a dome in the fuel rail for each fuel injector socket, each said dome communicating with the rail fuel passage and having a cross section with a maximum area at least twice that of the maximum area in cross section of the rail fuel passage, and the fuel injector socket is received in the dome and encircled by the dome, a demand fuel pressure regulator for providing fuel at a regulated pressure through said rail fuel passage to all of said fuel injectors through said socket apertures, said regulator having a fuel inlet communicating with a fuel reservoir, and at least one fuel outlet communicating with said fuel rail, and a pressure regulator socket formed integrally with said fuel rail for receiving said regulator therein such that said regulator fuel outlet is disposed upstream of all of said injector sockets for providing fuel at a regulated pressure directly to said injectors through said rail fuel passage and wherein said rail has no return fuel outlet downstream of any of the fuel injectors.

7. A fuel rail assembly for a no-return fuel delivery system for an internal combustion engine with a plurality of fuel injectors each having an injector fuel inlet, the rail assembly comprising:

a fuel rail constructed of an elongate member having a cross section defining a rail fuel passage therein and having a plurality of fuel injector sockets each for receiving one fuel injector inlet therein and each having a socket aperture communicating with said rail fuel passage and said injector fuel inlet, a demand fuel pressure regulator for providing fuel at a regulated pressure through said rail fuel passage to all of said fuel injectors through said socket apertures said regulator having a fuel inlet communicating with a fuel reservoir, and at least one fuel outlet communicating with said fuel rail, a pressure regulator socket formed integrally with said fuel rail for receiving said regulator therein such that said regulator fuel outlet is disposed upstream of all of said injector sockets for providing fuel at a regulated pressure directly to said injectors through said rail fuel passage and wherein said rail has no return fuel outlet downstream of any of the fuel injectors, said regulator socket has a dome communicating with said rail fuel passage and having in cross section a maximum area at least twice that of the maximum area in cross section of the rail fuel passage, a recess having an annular wall formed integrally with said fuel rail and encircled by said dome, said annular recess being constructed to receive the pressure regulator therein, an opening through said recess and communicating with the rail fuel passage and a fuel outlet of the pressure regulator for delivering liquid fuel from the pressure regulator to the rail fuel passage, and a fuel supply inlet communicating with the fuel inlet of the pressure regulator for supplying liquid fuel thereto and having an annular wall formed integrally with the fuel rail and spaced from and substantially coaxial with the annular recess.

8. The fuel rail assembly of claim 7 which also comprises a first O-ring received in said recess and providing a seal between the pressure regulator fuel outlet and the recess and a second O-ring received between the annular wall of the fuel supply inlet and the inlet of the pressure regulator and providing a seal between them.

9. The fuel rail assembly of claim 7 which also comprises a spring clip constructed and arranged to retain the pressure regulator in said regulator socket.

10. A fuel rail assembly for a no-return fuel delivery system for an internal combustion engine with a plurality of fuel injectors each having an injector fuel inlet, the rail assembly comprising:

a rail assembly having a fuel rail with an elongated top section of sheet metal and a similarity elongated confronting bottom section of sheet metal having a cross section defining a rail fuel passage therein and having a plurality of fuel injector sockets integrally formed in the bottom section and each for receiving one fuel injector inlet therein and each having a socket aperture communicating the rail fuel passage with the injector fuel inlet, a pressure regulator socket formed integrally in one of said sections for receiving a demand fuel pressure regulator therein having a fuel inlet and a fuel outlet such that the regulator fuel outlet is disposed upstream of all of the injector sockets for providing the fuel at a regulated pressure directly to the injectors through only the rail fuel passage and wherein the rail has no return fuel outlet downstream of any of the fuel injectors, and said regulator socket is disposed longitudinally between the fuel injector sockets to substantially minimize and equalize the linear distance fuel must travel from said regulator to the most remote of said injectors on both sides of said regulator socket.

11. The fuel rail assembly of claim 10 wherein said regulator socket comprises an annular ring formed integrally with said fuel rail, said ring having a generally circular cross section defining a regulated fuel passage therein which opens into said rail fuel passage for delivering fuel from said regulator outlet to said injectors through said rail fuel passage.

12. The fuel rail assembly of claim 10 wherein for each fuel injector socket the fuel rail has a dome communicating with the rail fuel passage and having a cross section with a maximum area at least twice that of the maximum area in cross section of the rail fuel passage, and the fuel injector socket is received in the dome and encircled by the dome.

13. A fuel rail assembly for a no-return fuel delivery system for an internal combustion engine with a plurality of fuel injectors each having an injector fuel inlet, the rail assembly comprising:

a rail assembly having a fuel rail with an elongated top section of sheet metal and a similarity elongated confronting bottom section of sheet metal having a cross section defining a rail fuel passage therein and having a plurality of fuel injector sockets integrally formed in the bottom section and each for receiving one fuel injector inlet therein and each having a socket aperture communicating the rail fuel passage with the injector fuel inlet, a pressure regulator socket formed integrally in one of said sections for receiving a demand fuel pressure regulator therein having a fuel inlet and a fuel outlet such that the regulator fuel outlet is disposed upstream of all of the injector sockets for providing the fuel at a regulated pressure directly to the injectors through only the rail fuel passage and wherein the rail has no return fuel outlet downstream of any of the fuel injectors, said regulator socket has a dome communicating with said rail fuel passage and having in cross section a maximum area at least twice that of the maximum area in cross section of the rail fuel passage, a recess having an annular wall formed integrally with said fuel rail and encircled by said dome, said annular recess being constructed to receive the pressure regulator therein, an opening through said recess and communicating with the rail fuel passage and a fuel outlet of the pressure regulator for delivering liquid fuel from the pressure regulator to the rail fuel passage, and a fuel supply inlet communicating with the fuel inlet of the pressure regulator for supplying liquid fuel thereto, and having an annular wall formed integrally with the fuel rail and spaced from and substantially coaxial with the annular recess.

14. The fuel rail assembly of claim 13 which also comprises a first O-ring received in said recess and providing a seal between the pressure regulator fuel outlet and the recess and a second O-ring received between the annular wall of the fuel supply inlet and the inlet of the pressure regulator and providing a seal between them.

15. The fuel rail assembly of claim 13 which also comprises a spring clip constructed and arranged to retain a pressure regulator in said regulator socket.

16. The fuel rail assembly of claim 13 wherein said regulator socket is disposed at about the longitudinal midpoint of said rail assembly.

17. The fuel rail assembly of claim 16 wherein said regulator socket is disposed between the fuel injector sockets to minimize the linear distance fuel must travel from said regulator to the most remote of said injectors on either side of said regulator socket.

18. The fuel rail assembly of claim 7 wherein said regulator socket is disposed longitudinally between the fuel injector sockets to substantially minimize and equalize the linear distance fuel must travel from said regulator to the most remote of said injectors on both sides of said regulator socket.

19. The fuel rail assembly of claim 6 wherein the fuel rail comprises an elongated top section and a similarity elongated confronting bottom section, and said sections are sealingly joined together and define said fuel rail passage.

20. The fuel rail assembly of claim 7 wherein the fuel rail comprises an elongated top section and a similarity elongated confronting bottom section, and said sections are sealingly joined together and define said fuel rail passage.

* * * * *

UNITED STATES PATENT AND TRADEMARK OFFICE

CERTIFICATE OF CORRECTION

PATENT NO. : 5,577,478
DATED : November 26, 1996
INVENTOR(S) : Charles H. Tuckey It is certified that error appears in the above-indentified patent and that said Letters Patent is hereby corrected as shown below:

Col. 6, Line 23, change "similarity" to "similarly".

Col. 6, Line 63, change "similarity" to "similarly".

Col. 8, Line 23, change "similarity" to "similarly".

Col. 8, Line 27, change "similarity" to "similarly".

Signed and Sealed this

Fourth Day of March, 1997

Bruce Lehman

*Attest:*

BRUCE LEHMAN

*Attesting Officer*

*Commissioner of Patents and Trademarks*